United States Patent [19]

Pehr

[11] 4,353,483

[45] Oct. 12, 1982

[54] CONTAINER CAP HAVING SAFETY LOCKING MEANS

[76] Inventor: Harold T. Pehr, 253 Merihil Office Center, 6900 W. 80th St., Overland Park, Kans. 66204

[21] Appl. No.: 209,671

[22] Filed: Nov. 24, 1980

[51] Int. Cl.[3] ..... B65D 47/08

[52] U.S. Cl. ..... 222/153; 222/182; 215/216; 215/224; 220/85 P; 220/306

[58] Field of Search ..... 220/85 P, 306, 335; 215/216, 224, 225; 222/153, 182, 541, 465, 3, 175; 137/382

[56] References Cited

U.S. PATENT DOCUMENTS

| | | | |
|---|---|---|---|
| Re. 29,793 | 10/1978 | Pehr . | |
| 3,037,672 | 6/1962 | Gach . | |
| 3,097,758 | 7/1963 | Gershen et al. . | |
| 3,125,259 | 3/1964 | Young . | |
| 3,162,329 | 12/1964 | Gregory . | |
| 3,185,336 | 5/1965 | Goss | 220/85 P |
| 3,438,537 | 4/1969 | Hendrickson et al. . | |
| 3,460,708 | 8/1969 | Vollers . | |
| 3,480,184 | 11/1969 | Landis . | |
| 3,544,024 | 12/1970 | Hendrickson et al. . | |
| 3,737,064 | 6/1973 | Patel et al. . | |
| 3,788,549 | 1/1974 | Ostrowsky . | |
| 3,881,638 | 5/1975 | Grothoff . | |
| 4,103,806 | 8/1978 | White | 220/85 P X |

*Primary Examiner*—George T. Hall

*Attorney, Agent, or Firm*—Litman, Day and McMahon

[57] ABSTRACT

A one piece molded closure cap for a material dispensing container having a material dispensing valve and nozzle such as an aerosol can. The cap comprises a ring member securely mounted to the can, a closure member hingedly connected to the ring member and a tamper guard which is positioned over the dispensing nozzle and is connected to the ring member by frangible fingers. The tamper guard prevents manipulation of the dispensing valve prior to the removal thereof. In another embodiment, the ring member and closure member are molded with a nozzle which is connected to the ring member by frangible means such that the nozzle functions as a tamper guard. In another embodiment a latch is provided which has two operable positions with one position allowing the closure lid to be opened easier than by the other position.

14 Claims, 34 Drawing Figures

Fig. 1.
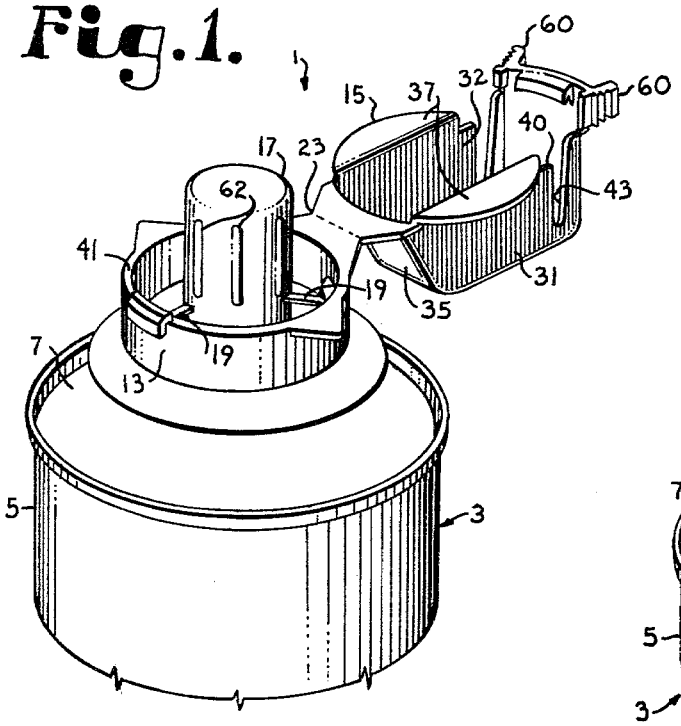
Fig. 2.
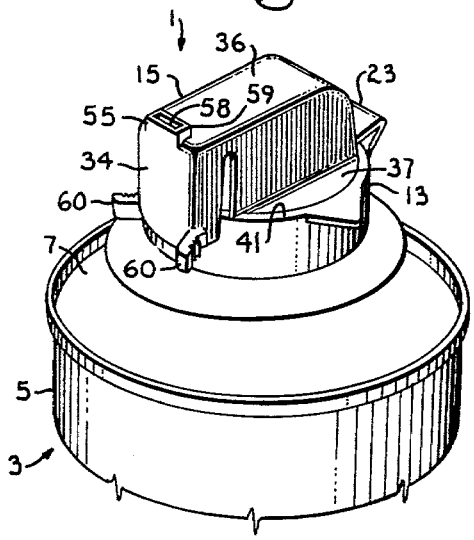
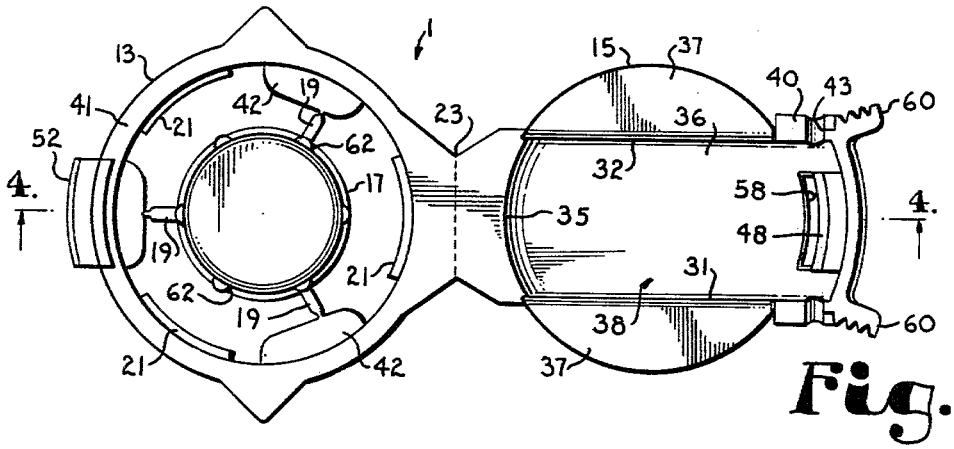
Fig. 3.
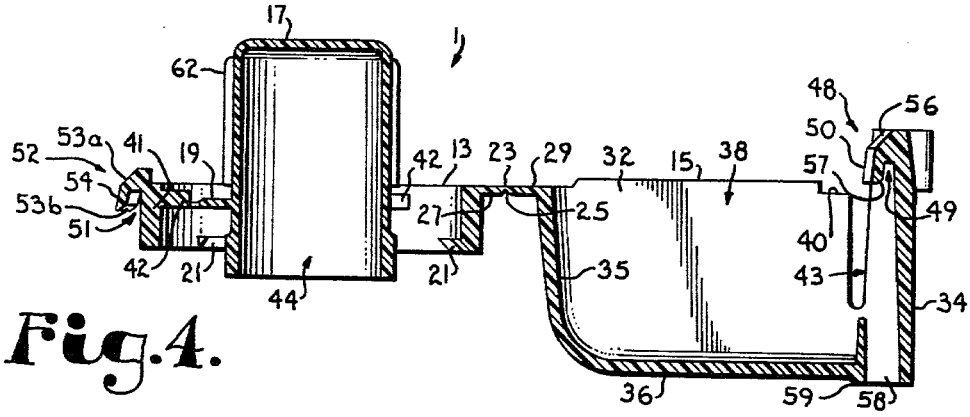
Fig. 4.

Fig. 5.
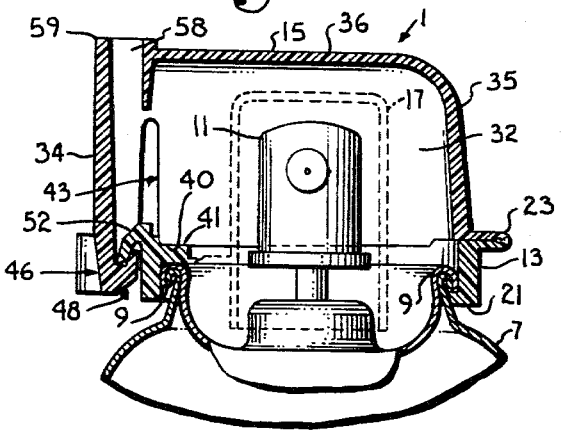
Fig. 6.
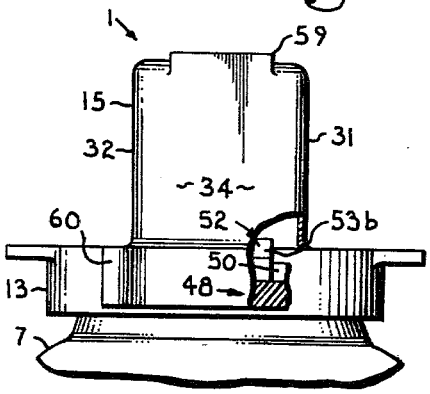
Fig. 7.
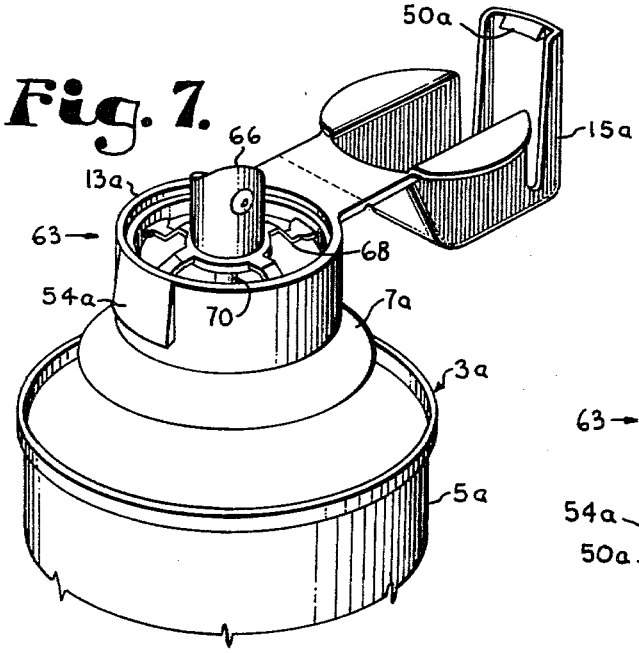
Fig. 9.
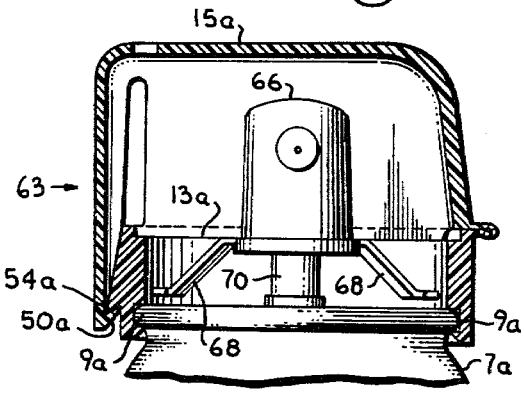
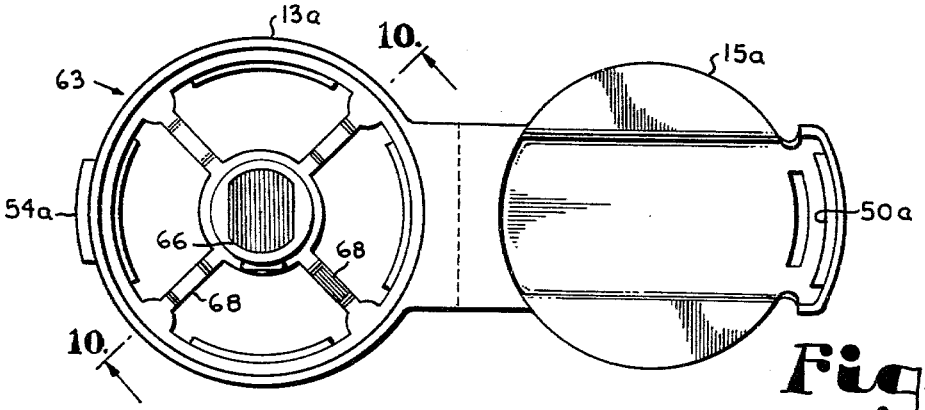
Fig. 8.

Fig. 15.
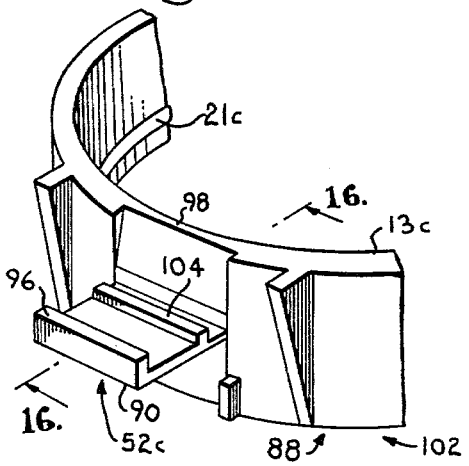
Fig. 21.
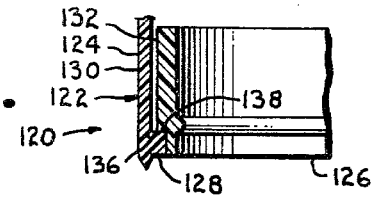
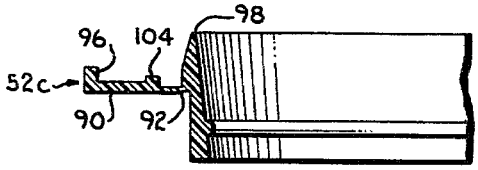
Fig. 16.
Fig. 17.
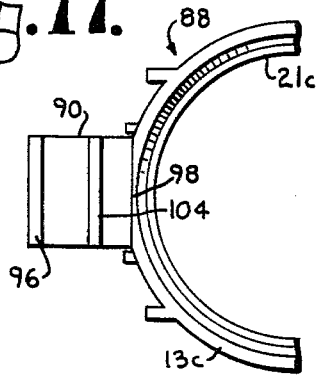
Fig. 18.
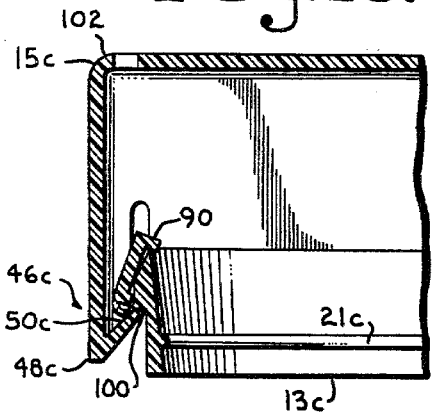
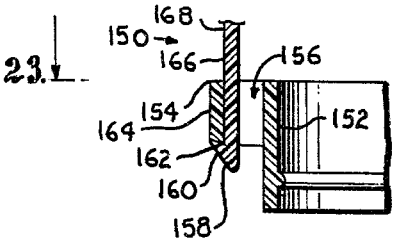
Fig. 22.
Fig. 19.
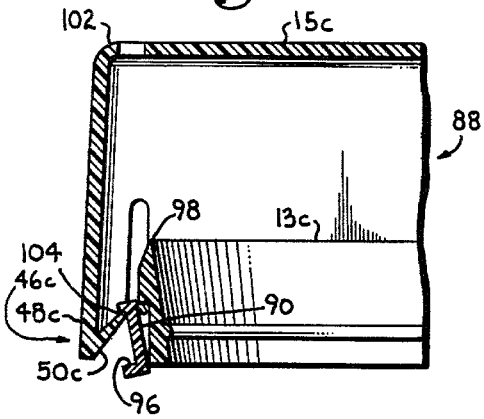
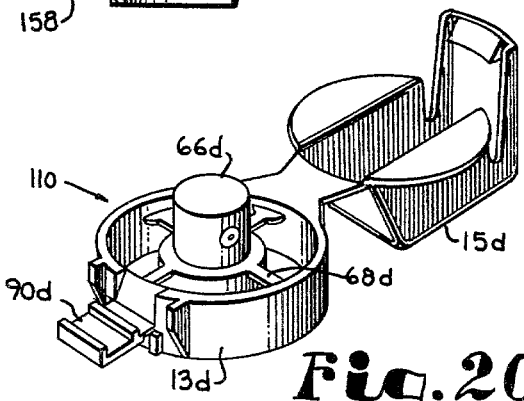
Fig. 20.

Fig. 23.
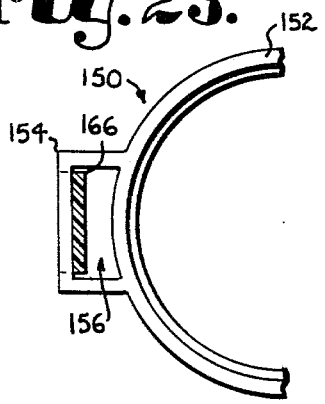
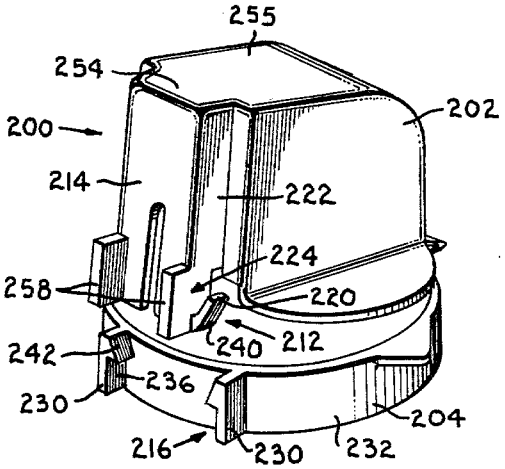
Fig. 24.
Fig. 25.
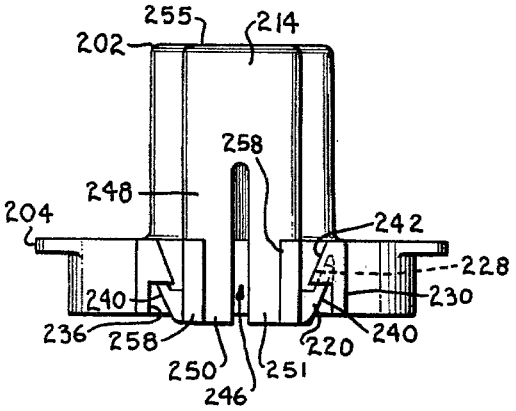
Fig. 26.
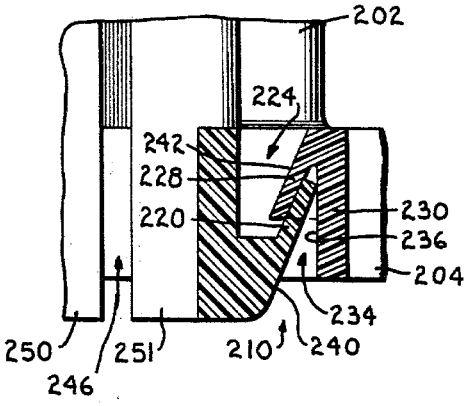
Fig. 27.
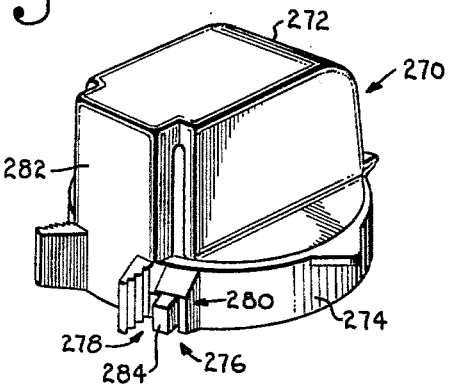
Fig. 28.
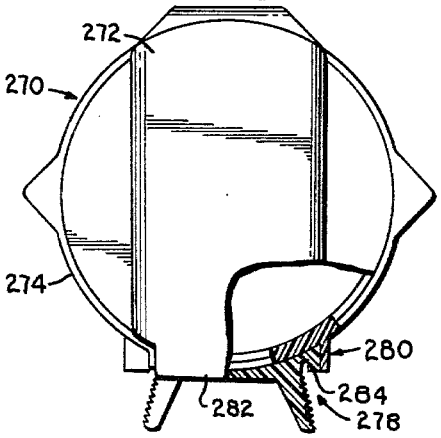

CONTAINER CAP HAVING SAFETY LOCKING MEANS

BACKGROUND OF THE INVENTION

This invention relates to material dispensing containers and particularly to closure caps positioned on the container. The closure cap has a hingedly connected closure member and includes a tamper guard integrally molded therewith to prevent dispensing of the material prior to the use by the ultimate user.

There are many types of material dispensing can caps which have been integrated with a tamper guard. Such guards usually have comprised a frangible tab portion which retainingly engages a lip of the can and which when broken or removed from the cap allows the cap to be easily removed from the can. Also, many caps have been developed that are of the child-proof type in that they require multiple or complex manipulations to allow the removal thereof.

One of the drawbacks in the prior art is that in tamper-proof and child-proof caps, the cap lid is not attached to the structure itself and once removed is either accidentally or purposely misplaced to allow the easy opening thereof without manipulating the child-proof device.

Another drawback in the prior art is that the child-proof caps have not been capable of being converted from an easy opening type cap to a child-proof type cap. Yet another drawback in the prior art is that the cap assembly has been fabricated apart from the material dispensing nozzle which necessitates two operations, first, placing the nozzle into operable relationship with the container and secondly placing the cap on the container.

OBJECTS OF THE INVENTION

Therefore, the principle objects of the present invention are: to provide a material dispensing container closure cap that is integrally molded and which has the closure member hingedly connected to a ring member, which ring member is adapted to be securely attached to the material dispensing container; to provide such a closure cap which has integrally molded therewith a tamper proof guard member; to provide such a guard member which is frangibly attached to the closure cap; to further provide a cap which has integrally attached thereto a material dispening nozzle; to provide such a nozzle which is attached to the closure cap by frangible means to provide a tamper guard; to provide such a closure cap having a latch which makes the closure cap child-proof; to provide such a latch which is selectively manipulative into two positions, with one position being harder to open than the other position; to provide such a closure cap which is simple in design, molded in one piece, and attachable to an associated material dispensing can in one step; to provide such a closure cap which is easy to manufacture, capable of extended useful life, and particularly well adapted for the intended use thereof.

Other objects and advantages of this invention will become apparent from the following description taken in connection with the accompanying drawings wherein are set forth, by way of illustration and example certain embodiments of this invention.

SUMMARY OF THE INVENTION

An intergrally molded closure cap is provided for a material dispensing container such as an aerosol can having a material dispensing valve and nozzle. A ring member is mounted on the container and has hingedly attached thereto a closure member. Latching means are provided on the closure member and ring member to selectively retain the closure member in covered relation to the material dispensing nozzle. To open the closure member it is necessary to move the closure member toward the ring member prior to releasing the closure member latching means. A tamper guard is provided which is molded integrally with the closure cap to prevent manipulation of the material dispensing valve prior to the initial use by the intended user.

In a modified embodiment, an aerosol actuator nozzle is integrally molded with the cap and is attached thereto by frangible means which is broken when the valve is first used, thereby providing an additional tamper guard.

In another modified embodiment, the associated cap latching means comprises mechanism which may be selectively manipulated between two positions, one being easier to open than the other.

The drawings constitute a part of this specification and include exemplary embodiments of the present invention and illustrate various objects and features thereof.

BRIEF DESCRIPTION OF THE DRAWINGS

FIG. 1 is a perspective view of a material dispensing can having a closure cap comprising a ring member, a tamper guard, and a closure member embodying features of the present invention and showing the closure member in an open position and the tamper guard in operable position.

FIG. 2 is a perspective view of the closure cap positioned on an associated can, with the closure member in a closed position.

FIG. 3 is an enlarged top plan view of the closure cap with the closure member in open position.

FIG. 4 is a cross-sectional view of the closure cap taken along line 4—4 in FIG. 3.

FIG. 5 is a partial enlarged cross-sectional view of the closure cap positioned on an associated can with the closure member in a closed position and with the tamper guard shown in phantom lines.

FIG. 6 is an enlarged front elevational view of the closure cap with the closure member in closed position and with portions broken away to show details thereof.

FIG. 7 is a perspective view of a dispensing can having a first modified embodiment of a closure cap according to the present invention, the closure cap including a material dispensing actuator nozzle frangibly connected to a ring member of the closure cap.

FIG. 8 is an enlarged top plan view of the first modified embodiment of the closure cap with the closure member shown in open position.

FIG. 9 is a partial cross-sectional view of the first modified embodiment showing the actuator valve.

FIG. 15 is a partial perspective view of the ring member of a third modified embodiment of a closure cap.

FIG. 16 is a partial cross-sectional view of the ring member of the third modified embodiment taken along line 16—16 of FIG. 15.

FIG. 17 is a partial top plan view of the ring member of the third modified embodiment of the closure cap.

FIG. 18 is a partial cross-sectional view of the third modified embodiment of the closure cap showing the ring member with a closure cover in closed position with the convertible ring member latching portion in a first position thereof.

FIG. 19 is another partial cross-sectional view of the third modified embodiment of the closure cap showing the closure member in closed position with the ring member latch portion in a second position thereof.

FIG. 20 is a perspective view of a fourth modified embodiment of a closure cap showing a ring member with a closure member hingedly attached thereto, a ring member selectable latch portion and an actuator valve are integrally attached to the ring member on frangible means.

FIG. 21 is a cross-sectional view of a latch mechanism of a fifth modified embodiment of the closure cap.

FIG. 22 is a cross-sectional view of a latch mechanism of a sixth modified embodiment of the closure cap.

FIG. 23 is a cross-sectional view taken along line 23—23 in FIG. 22.

FIG. 24 is a perspective view of a seventh modified embodiment of a closure cap.

FIG. 25 is a front elevational view of the closure cap as shown in FIG. 24.

FIG. 26 is an enlarged fragmentary view of a latch mechanism of the closure cap shown in FIG. 24 showing details thereof.

FIG. 27 is a perspective view of an eighth modified embodiment of a closure cap.

FIG. 28 is a top plan view of the closure cap shown in FIG. 27 with portions broken away to show details thereof.

DETAILED DESCRIPTION OF THE PREFERRED EMBODIMENT

Figure 10:
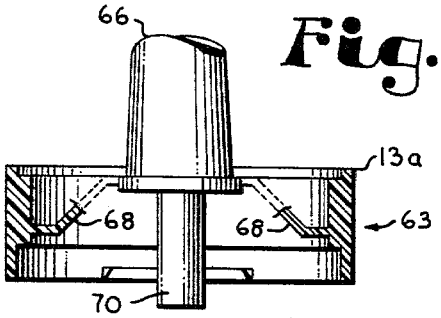
FIG. 10 is a partial cross-sectional view of the first modified embodiment of the closure cap taken along line 10—10 in FIG. 9.
Figure 11:
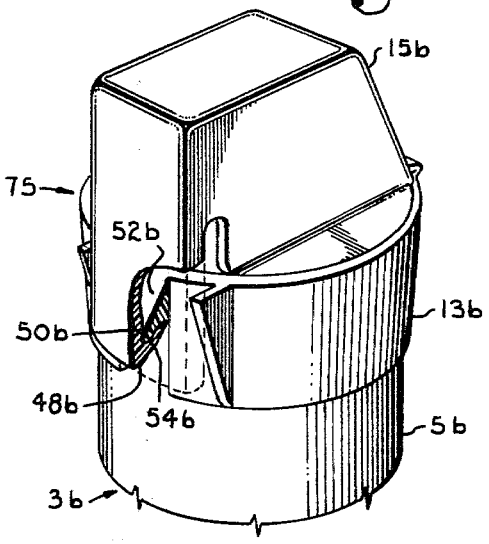
FIG. 11 is a perspective view of a dispensing can having a second modified embodiment of a closure cap comprising a ring member and a closure member with the closure member shown in closed position and with portions broken away to show details thereof.
Figure 12:
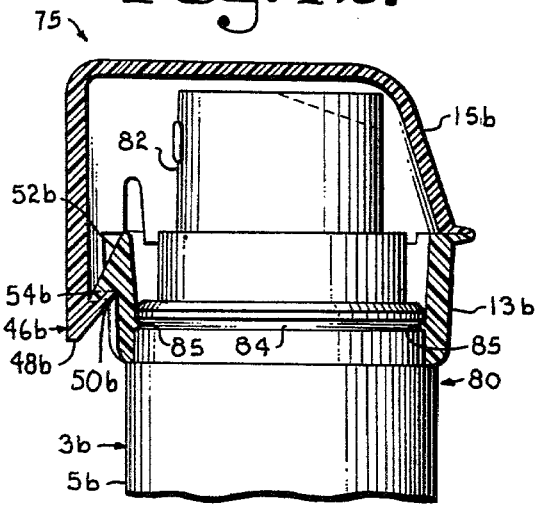
FIG. 12 is a cross-sectional view of the second modified embodiment of the closure cap positioned on an associated material dispensing can.
Figure 13:
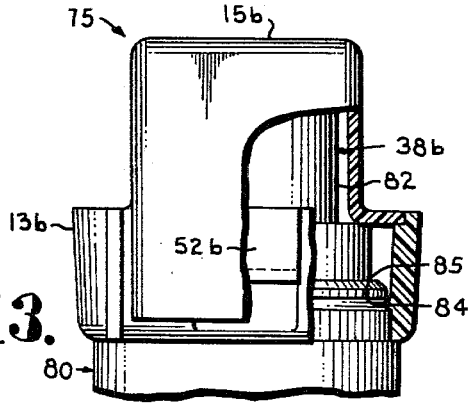
FIG. 13 is a front elevational view of the second modified embodiment of the closure cap with portions broken away to show details thereof.
Figure 14:
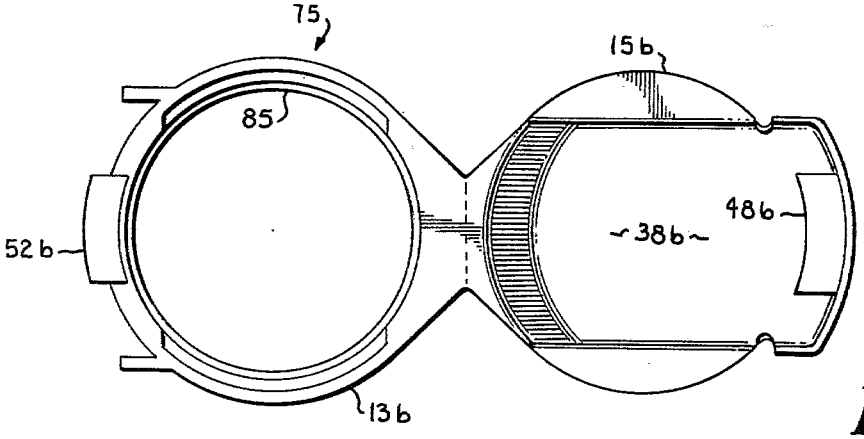
FIG. 14 is a top plan view of the second modified embodiment of the closure cap with the closure member shown in open position.

As required detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

As used herein, the term "front" in describing closure caps of the present invention, refers to that portion of the caps which is to the left in FIGS. 5, 9, 12, and 18. Other directional terms have the normal meaning thereof relative to the term "front".

Referring now in detail to the embodiment shown in FIGS. 1 through 6:

The reference numeral 1 generally refers to a closure cap. As shown, the closure cap 1 is positioned on an associated material dispensing container shown here as an aerosol can 3. The aerosol can 3 comprises a body portion 5, a domed top portion 7, an outwardly extending annular shoulder portion 9, as seen in FIG. 5, and a material dispensing member such as aerosol nozzle 11.

The closure cap 1 comprises a ring portion 13, a closure member 15 which is hingedly connected to the ring portion and a tamper guard 17 which is positioned inside the ring portion 13 and which is connected to the ring portion 13 by frangible means such as fingers 19.

The ring portion 13 has radially inward projecting arcuate lip members 21 circumferentially spaced around a lower end thereof. The lip members 21 securely engage the can shoulder portion 9 when the closure cap 1 is positioned thereon.

The closure member 15 pivots about a hinge point 23 which, as shown in FIG. 4, is defined by groove 25 on a lower surface 27 of a web 29 which connects the ring member 13 and the closure member 15. The closure member 15 comprises generally vertical side wall portions 31 and 32, a front wall portion 34, a rear wall portion 35, a top portion 36 and semi-circular flanges 37 which extend outwardly from a bottom edge of the side walls 31 and 32. The closure member walls 31 and 32, top portion 36 and front and rear portions 34 and 35 define therein a chamber 38 which, when the closure member is in a closed position thereof as shown in FIG. 2, non-engagingly receives the tamper guard 17, thereby preventing inadvertent manipulation of such a tamper guard.

On the closure member side walls 31 and 32 near a front portion thereof are notches 40 which, when the closure member is in a closed position, abut against a lip 41 of ring 13 to limit or prevent the closure member 15 from being depressed so as to come in contact with the tamper guard 17 or the aerosol nozzle 11. To further prevent the closure member 15 from contacting tamper guard 17 and the aerosol nozzle 11, stop members 42 are provided which project inwardly from the ring member 13 and are positioned to allow contact therewith by the closure member flanges 37. The stop members 42 each connect a respective frangible finger 19 to the ring member 13. Release notches 43 are also provided which allow the closure member front wall 34 to flexibly but resiliently pivot forwardly under manipulation by a user to allow opening of the closure member 15.

The tamper guard 17 comprises a closed end cylindrical member having a cavity 44 therein which non-engagingly receives the aerosol nozzle 11, as shown in FIG. 5 in phantom lines. When in operable position, so as to prevent unnoticed tampering with the nozzle 11, the tamper guard 17 neither contacts the aerosol nozzle 11 nor the closure member 15. In this way the tamper guard 17 prohibits manipulation of the aerosol nozzle prior to breaking of the fingers 19 and the removal thereof by the intended user.

Latching means such as the illustrated latch 46 are provided which comprise two cooperating parts, a first 48, on the closure member 15, and a second 52, on the ring member 13. The first cooperating means 48 comprises a tang 50 which includes a first surface 56 and a second surface 57. The tang 50 is spaced apart from the closure member front wall 34 defining therebetween a slot 49, FIG. 4. The ring member cooperating part 52 comprises an associated outwardly projecting shoulder 54 including a first inclined surface **53*a* and a second inclined surface 53*b*. The shoulder 54 is spaced apart from ring member 13, forming a channel 51 therebetween, FIG. 4. When the closure member 15 is in closed position as shown in FIG. 5, tang 50 is received in channel 51 and shoulder 54 is received in slot 49**.

The closure cap 1 is preferably made of a resilient molded plastic such as high density polyethylene or polypropylene which is sufficiently stiff to allow the tang 50 and the shoulder 54 to be retained in closing engagement until the opening thereof by a user is desired.

The geometry of the latch is such that, upon closing, the tang first surface 56 engages the shoulder first surface **53*a* urging the tang 48 and closure member front wall 34 outwardly. Upon latching, because of the resilient nature of the closure cap 1, the tang 50 is biased inwardly such that tang second surface 57 overlaps the shoulder second surface 53*b*. Further, the tang second surface 57 will operably engage the shoulder second surface 53*b* and be retainedly engaged therewith. It is noted that when a force is exerted downwardly on the closure member front wall 34 the tang 50 will not be biased outwardly from the ring member shoulder 54, but will still overlap same thereby preventing inadvertent opening of the closure cap 1**.

The depth of the slot 49 and channel 51 can be of any appropriate depth. It has been found that if both depths are in the area of 0.090 inches the closure cap is relatively difficult to open. In order to open the closure cap 15, when the depth of slot 49 and channel 51 is 0.090 inches, a downward force must be exerted on the closure member 15 at a front portion thereof 55 near an aperture 58 thereby vertically separating the closure member tang 50 and the ring member shoulder 54. The aperture 58 has a ridge 59 therearound which functions to provide a place of abutment for a user's finger necessary to depress the closure member front portion 55. It is noted that downward movement of the closure member 15 is limited by the ring lip 41 and stop members 42. Grasping members 60 extend outwardly from the closure member 15 near the tang portion 50, and, in order to complete opening of the closure cap 1, a force must be exerted on the grasping members 60 to pull the closure member tang 50 outwardly away from the ring member shoulder 54 thereby allowing the closure member 15 to be open. The cap closure member is illustrated in the open position thereof in FIGS. 1 and 3.

If the depth of the slot 49 and channel 51 are in the nature of 0.030 inches it is found that the cap 1 can be opened solely by exerting an outward force on the grasping members 60 without exerting a downward pressure on the closure member front portion 55.

When the depth of the slot 49 and channel 51 is in the nature of 0.090 inches the closure cap 1 can be effectively used as a child-proof cap for materials such as insecticides and oven cleaners.

As shown in FIGS. 1 through 6, the closure cap 1 is a one piece molded assembly that can be snapped onto an existing aerosol can 3 that has the actuator nozzle 11 already positioned therein. To dispense material the tamper guard 17 is removed from the closure cap by fracturing the frangible fingers 19 by either depressing or twisting the tamper guard 17. Vertical ridges 62 are provided around the tamper guard 17 to allow a user to grip the same and thereby twist such a tamper guard from the surrounding structure when the closure member 15 is in the open position thereof.

As shown in FIG. 5 the direction of the aerosol nozzle 11 is normal to the hinged motion of the closure member 15, such that when the closure member 15 is in the open position thereof, same does not interfere with placement of a user's finger on the nozzle 11, therefore allowing the user to depress the nozzle 11 as he normally would if there were no cap 1.

In FIGS. 7 through 10, a first modified embodiment of a closure cap 63 is shown. Since there are many elements in the closure cap 63 which are similar to the elements of cap 1, similar elements appearing in the latter figures have the same number as the earlier figures except the latter include the suffix "a".

In FIG. 7, the reference numeral 63 generally designates the first modified embodiment of the closure cap. The closure cap 63 is shown as positioned on an aerosol can **3*a*, which comprises a body portion 5*a*, a domed portion 7*a* and an annular shoulder portion 9*a*, FIG. 9. The closure cap 63 comprises a ring portion 13*a*, a closure member 15*a* hingedly connected to the ring portion 13*a* and an integrally molded aerosol nozzle 66. The nozzle 66 is initially connected to the ring member 13*a* by frangible means such as tabs 68. The nozzle 66 has extending downwardly therefrom to the can 3*a*, a tubular passage 70 which operably communicates with an aerosol valve (not shown) positioned in can 3*a***.

By placing the aerosol nozzle 66 on frangible tabs 68 which must be broken before the nozzle 66 can be depressed so as to engage and open the aerosol valve (not shown) in the can **3*a*, the nozzle 66 effectively functions as a tamper guard. Prior to fracturing the tabs 68 the tubular passage 70 is prohibited from movement relative to the can 3*a*. Upon fracturing the tabs 68, by depressing the nozzle 66, the passage 70 engages the aerosol valve thereby allowing the dispensing of the material within the can 3*a*. By molding the nozzle 66 with the closure cap 63 such a nozzle and cap can be positioned on the aerosol can 3*a*** with only one operation during manufacture thereof thereby saving labor relative to placement of separate parts.

It is noted in the first modified embodiment, as shown in FIG. 9, a closure member latch tang **50*a* and an associated ring member latch shoulder 54*a* are of such depth as to require a minimal amount of outwardly exerted pressure to disengage same and allow for opening of the closure member 15*a***.

A second modified embodiment of a closure cap 75 is shown in FIGS. 11 through 14. The closure cap 75 is adapted to fit on a top portion of a material dispensing can which incorporates therein a pump assembly.

Since many of the features of the second modified embodiment are the same as in the first embodiment of FIG. 1 through 6, the same numbers will be utilized for similar elements in both embodiments with the letter "b" after the number to designate elements of structure which are in the second modified embodiment.

In the second modified embodiment of FIGS. 11 through 14 the closure cap, generally designated by the reference numeral 75, is shown mounted on the top of a material dispensing container such as can 3*b*, which can comprises a body 5*b*, a top portion 80 and a material dispensing member such as pump actuator 82. Circumscribing the top portion 80 of the can body 5*b* is an inwardly projecting groove 84. A ridge 85 projects inwardly from an inner cylindrical surface 86 of cap 75 and is received in groove 84 to securely retain the cap 74 on the can body 3*b*.

The closure cap 75 comprises a ring member 13*b* and a hingedly connected closure member 15*b*. Latch mechanism 46*b* comprises a closure member cooperating part 48*b* which is an inwardly and upwardly projecting tang 50*b* and a ring member cooperating part 52*b* comprises a downwardly projecting shoulder 54*b* which interlockingly engages the tang 50*b* thereby securing the closure member 15*b* in covering relation with the pump actuator member 82. The closure cap 75, as set out in FIGS. 11 through 14, is designed to be used with material dispenser cans such as 3*b* that are relatively large sized such as insect spray repellant cans and the like. Usually in these cans the pump actuator 82 is much larger in size than in a regular aerosol can and therefore a chamber 38*b* defined by the closure member 15*b* is much larger in size although its function is the same as in the first embodiment.

A third modified embodiment of the present invention is shown in FIGS. 15 through 19. Elements of the structure disclosed in the third modified embodiment which is the same as in the first embodiment are delineated by the same reference numerals as the first embodiment with addition of the suffix "c" thereto.

The reference numeral 88 generally refers to a closure cap comprising a ring member 13*c*, having projecting inwardly from an inner surface thereof an annular lip member 21*c* which engages an associated circumferential groove (not shown) on an associated material dispensing can (not shown), a closure member 15*c*, as seen in FIG. 18 and FIG. 19 and securing means such as latch 46*c*.

A latch ring member cooperating part 52*c* includes a tab 90 which tab is selectively positioned in one of two positions. The tab 90 is integrally molded with the ring member 13*c* and is hingedly attached along one edge 92 thereof so as to allow pivotal movement upward to a first locking position as shown in FIG. 18 whereby a top notch portion 96 of tab 90 is retainedly engaged by an upper lip 98 of ring member 13*c*. When the tab 90 is in this position an associated closure member tang 50*c* retainingly engages a lower surface 100 of the tab 90 at the point where a tab 90 is pivotally hinged to the ring member 13*c*.

In order to release the closure member 15*c* from its retained engagement with the ring member 13*c* when the tab 90 is in the first locking position it is preferable to exert a downward force on the closure member 15*c* near a front portion 102 thereof, while simultaneously exerting an outwardly acting force on a closure member cooperating part 48*c* thereby disengaging the closure member tang 50*c* from the ring member 13*c*.

When the tab 90 is rotated downwardly to a second locking position as shown in FIG. 19, the closure member tang 50*c* is retainingly engaged by a tab 104 near the hinged end of the tab 90. When the tab 90 is in the second locking position thereof only an outward force exerted on the closure member cooperating part 48*c* is necessary to disengage the closure member 15*c* from the ring member 13*c*.

It is noted that when the tab 90 is in the first locking position as shown in FIG. 18, the closure cap 88 is substantially child proof and when the tab 90 is in the second locking position as shown in FIG. 19 the closure cap 88 is relatively easy to open.

In a fourth modified embodiment shown in FIG. 20, many elements or portions of the structure are essentially the same as shown in the first embodiment and other modified embodiments and therefore will be referred to by the same numeral with the suffix "d" added thereto.

The fourth modified embodiment comprises a closure cap generally designated as 110 which comprises a ring member 13*d* and a closure member 15*d*. An aerosol actuator nozzle 66*d* is connected to the ring member 13*d* by frangible tabs 68*d* which function the same as tabs 68 in the first modified embodiment. A tab 90*d* functions the same as tab 90 in the third modified embodiment.

Thus it is seen that the closure cap 110, as set forth in FIG. 20, can provide a tamper guard nozzle 66*d* and a bipositioned tab 90 thereby making a tamper proof closure cap which is selectively child proof.

A fifth modified embodiment of a closure cap 120 comprising a closure member 124, a ring member 126 and a latch 122 is shown in FIG. 21. A tang 128 extends radially inwardly of a front wall 130 of closure member 124 and retainingly engages shoulder 132 which extends radially outwardly from ring member 126. As seen in FIG. 21, the shoulder 132 and tang 128 are formed such that mating surfaces thereof 136 and 138 respectively are not locked together so as to prohibit outward movement of tang 128 with respect to shoulder 132. The closure cap is thus easily opened. It is noted that the latch 122 as shown in FIG. 21 could be utilized with tamper guard 17 as shown in the embodiment shown in FIGS. 1 through 6 or the aerosol nozzle 66 as shown in FIGS. 7–10.

A sixth modified embodiment of a closure cap 150 is shown in FIGS. 22 and 23. The closure cap 150 is constructed such that a ring member 152 of the closure cap 150 has protruding outwardly therefrom a ring member latch means 154 which has defined therein a passageway of channel 156 which operably receives a closure cap lower portion 158. Projecting radially outwardly from the closure cap lower portion 158 is an upwardly and outwardly projecting tang 160 which operably engages an inclined shoulder 162 formed in a lower edge 164 of the ring member latch means 154.

In order to open the closure cap 150 a force must be exerted inwardly on a front wall 166 of the closure member 168 to thereby separate the tang 160 from the shoulder 152.

It is noted that the bi-positional tab 90, as shown in FIGS. 15 through 20, can be incorporated in any of the embodiments as shown. Also, the depth of the ring member shoulder and the closure member tang can be varied as indicated before on any of the embodiments as shown herein.

A seventh modified embodiment of a closure cap is shown in FIGS. 24 through 26 and is generally designated by the reference numeral 200.

The closure cap 200 comprises a closure member 202 and a ring member 204. The ring member 204 is retained on an associated material dispensing can (not shown) in a manner similar to that which holds the ring member 13 onto can 5 in the embodiment shown in FIGS. 1 through 5.

The closure cap 200 includes a latch mechanism 210 which functions to retain the closure member 202 in covering relation relative to the ring member 204.

The latch mechanism 210 comprises two cooperating parts, a first part 212 formed on a front wall 214 of closure member 202 and a second part 216 formed on an adjacent portion of ring member 204.

The closure member cooperating part 212 comprises an upwardly projecting (upwardly when the closure member 202 is closed as shown in FIG. 25) shoulder 220 which angles outwardly from a side wall 222 of closure member 206 defining therebetween a slot 224.

The ring member cooperating part 216 comprises a tang 228 which depends downwardly and inwardly from flanges 230 which flanges extend outwardly from a front cylindrical surface 232 of ring member 204. A groove 234 is defined between tang 228 and a side wall 236 of flange 230.

When the closure cap 202 is biased toward a closed position as shown in FIG. 25, a lower inclined surface 240 of shoulder members 220 abuts against a similarly inclined upper surface 242 of tang 228. Since the closure cap 200 is made of a resilient material similar to that which is used to fabricate the closure cap 1 in FIGS. 1 through 6, and since there is a relief groove 246 in a lower portion 248 of the closure cap front wall 214, upon further urging of the closure member 202 to a closed position, the translation of inclined shoulder surface 240 over inclined tang surface 242 urges opposing portions 250 and 251 of the front wall lower portion 248 inwardly, thereby allowing the closure member 202 to close. Because of the resiliency of the closure member 202, the opposing portions 250 and 251 spring outwardly such that shoulder 220 is received in groove 234 and tang 228 is received in slot 224, thereby securing the closure member 202 in closed position.

In order to open the closure member 202, a force must be exerted downwardly on a front portion 254 of a closure member top wall 255, thereby separating the closure member shoulder 220 from groove 234. Upon such a separation, inward force is applied to grasping members 258 to urge the front wall lower portion opposing portions 250 and 251 inwardly removing shoulders 220 from vertical alignment with tang 228 and thereby allowing the closure member 202 to open.

As stated before in regard to previous embodiments, the depth of groove 234 and slot 224 can vary to provide for a desired ease (or hardness) of opening of closure member 202.

An eighth modified embodiment of a closure cap is shown in FIGS. 27 and 28 and is generally designated by the reference numeral 270. The closure cap 270 comprises a closure member 272, a ring member 274 and a latch mechanism 276 which functions to selectively retain closure member 272 in closed relationship relative to ring member 274. The ring member 274 includes means (not shown) to securely retain the closure cap 270 on an associated material dispensing can (not shown).

The latch mechanism 276 is similar to the latch mechanism as shown in FIGS. 1 through 14, except that the cooperating latch mechanism parts of the closure member and ring member, 278 and 280 respectively, do not extend completely across a front wall 282 of closure member 272. Rather, the closure member cooperating parts are positioned on two tag members 284 which depend circumferentially outwardly from the closure member front wall 282. The tag members 284 mate with ring member cooperating parts 280 much in the same way as previously described.

Figure 29:
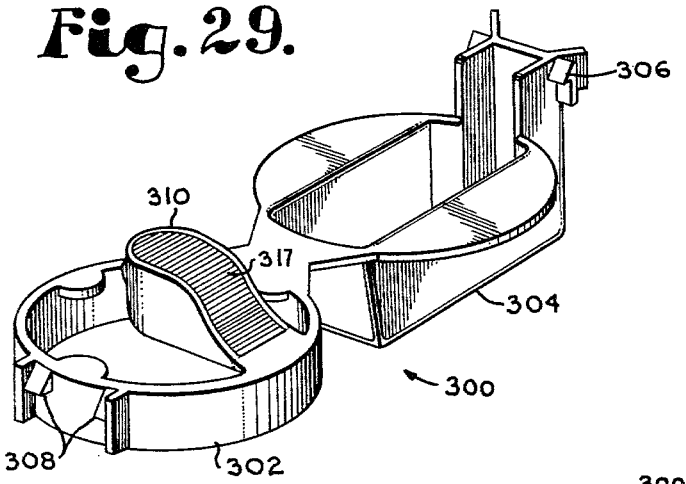
FIG. 29 is a perspective view of a ninth modified embodiment of a closure cap.
Figure 30:
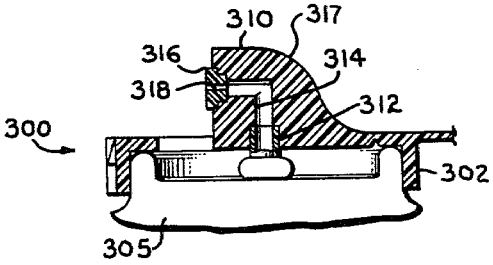
FIG. 30 is a partial vertical cross-sectional view of the closure cap shown in FIG. 29 mounted on a can.
Figure 31:
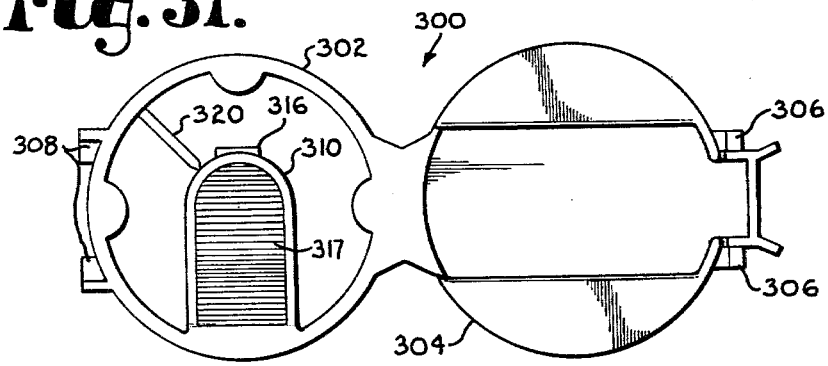
FIG. 31 is a top plan view of the closure cap of FIG. 29.

A ninth modified embodiment of a closure cap is shown in FIGS. 29–31 and is generally designated by the reference numeral 300. The closure cap 300 comprises a ring member 302 and a closure member 304, and is shown being securely retained on an associated container 305. The closure member 304 is hingedly connected to the ring member 302 as set out in the prior embodiments. The closure cap 300 includes a latch mechanism comprising cooperating parts on the closure member and ring member, 306 and 308 respectively. The design of the closure member latch mechanism and ring member latch mechanism could be any of those as set out in the prior embodiments.

Hingedly connected to the ring member 302 is a directionally oriented actuator 310 which includes a tubular member 312 which tubular member communicates at one end thereof with an associated valve (not shown) in the container 305 and which communicates at another end thereof with a passageway 314 which is formed in the actuator 310. An insert 316 having a bore 318 therein is received in the passageway 314 such that when the actuator 310 is activated, which in turn activates the associated container valve (not shown), material which is contained in the container 305 passes through the tubular member 312 to the passageway 314 and is dispersed through the insert 316. It is noted that the closure cap 300 can be unitarily molded without the insert 316, with an insert 316 having a desired bore size to accommodate varying materials placed therein after the molding of the closure cap 300.

The actuator 310 has a surface 317 which is contoured to that of a user's finger when placed thereon. Because of this a user will be able to feel if he is holding the can 305 correctly such that material dispensed from the can is directed away from the user. This prevents the user substantially from inadvertently spraying an undesired object such as himself.

As shown in FIG. 31, the closure cap 300 could include frangible members 320 which would function as a tamper guard similar in operation to those set out before.

Figure 33:
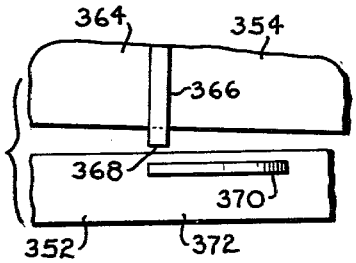
FIG. 33 is an enlarged and fragmentary side elevational view of the closure cap of FIG. 32 in a partially open position.
Figure 32:
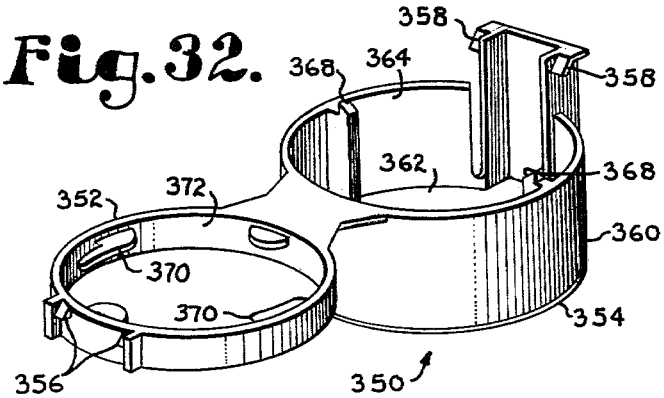
FIG. 32 is a perspective view of a tenth modified embodiment of a closure cap according to the present invention.
Figure 34:
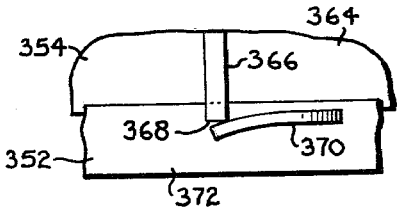
FIG. 34 is an enlarged and fragmentary side elevational view of the closure cap of FIG. 32 in a closed position.

FIGS. 32 through 34 show a tenth modified embodiment of a closure cap generally designated by the reference numeral 350. The closure cap 350 comprises a ring member 352, a closure member 354 hingedly attached to ring member 352 and a latch mechanism comprising ring member and closure member cooperating parts 356 and 358 respectively. The latch mechanism can be of any type as set out in previous embodiments.

The closure member 354 is cylindrical in shape having a side wall portion 360 and a top portion 362. A diameter of the closure member 354 is commensurate with that of the ring member 352.

The closure member 354 has projecting inwardly and downwardly when the closure member is closed from an inner cylindrical surface 364 thereof step members 366, of which a lower surface 368 thereof engages resilient tabs 370, which tabs are positioned inwardly of an inner surface 372 of ring member 352. As shown in FIGS. 33 and 34, upon closing the stop member lower surfaces 368 engage the tabs 370. The tabs 370 function to prevent the closure member 354 from being depressed such as to inadvertently engage an associated actuator nozzle (not shown) and to bias the closure member 354 and ring member 352 apart after the latch mechanism has been closed. This assures that the latch mechanism functions properly.

It is to be understood that while certain embodiments of the present invention have been illustrated and described herein it is not to be limited to the specific forms or arrangement of parts described and shown.

What is claimed and desired to secure by Letters Patent is:

1. A closure cap for use with a material dispensing container having a material dispensing nozzle; said cap comprising:

(a) a ring portion adapted to securely engage an aerosol can;

(b) a closure member hingedly connected to said ring portion;

(c) securing means to selectively secure said closure member in covering relationship with said nozzle such that said closure member is manipulative between a covering and a noncovering position thereof with respect to said nozzle; and (d) a tamper guard member removably connected to said ring portion in covering relation with respect to said nozzle and adapted to prohibit manipulation of said nozzle prior to removal of said guard member from said ring by a user of said can.

2. A cap as set forth in claim 1 for use with the container having an outwardly projecting annular lip portion in closely spaced and surrounding relationship to the nozzle wherein said ring portion includes:

(a) lip engaging members inwardly projecting from an inner surface of said ring portion; said lip engaging member being operably mated with said can lip portion when said ring portion is positioned on said container thereby securing said cap to said container.

3. A cap as set forth in claim 1 wherein said closure member includes:

(a) a chamber defined within said closure member such that when said closure member is in covering relation with said nozzle, said closure member nonengagingly receives said aerosol nozzle.

4. A cap as set forth in claim 1 wherein said securing means comprises:

(a) a latch member.

5. A cap as set forth in claim 4 wherein said latch member comprises:

(a) cooperating means first and second parts attached to said ring portion and said closure member respectively and being mateable with each other for retaining said closure member in covering relation with said material dispensing nozzle; and wherein (b) said closure member is resilient thereby urging said cooperating means first and second parts into mating engagement when positioned in opposing relationship, a portion of said closure member being movable by manipulation of a user against resistance of said resilient means to permit separation of said cooperating means first and second parts, whereby said cap may be opened.

6. A cap as set forth in claim 5 wherein:

(a) said cooperating means first part comprises a shoulder; and (b) said cooperating means second part comprises a tang; said tang interlocking with said shoulder when positioned in closely spaced relation.

7. The cap as set forth in claim 6 wherein:

(a) said shoulder is a first shoulder having a first depth; and (b) said cooperating means first part also includes a second shoulder having a second depth relatively deeper than said first depth; and (c) said cooperating means first part being hinged to said ring member and being manipulative so as to be selectively adjustable such that said first shoulder and said second shoulder can be alternatively positioned so as to mate with said tang whereby separation of said closure member from said ring member is respectively easier or harder.

8. A cap as set forth in claim 1 wherein said tamper guard member comprises:

(a) a cylindrical member having one closed end defining therein a cavity which operably non-engagingly receives said aerosol nozzle.

9. A cap as set forth in claim 8 wherein:

(a) said tamper guard member is connected to said ring member by a plurality of frangible fingers.

10. An integrally molded tamper responsive closure cap assembly for use on an aerosol can comprising:

(a) a ring member adapted to securely engage a top portion of the aerosol can;

(b) a closure member hingedly mounted on said ring member;

(c) means to selectively secure said closure member in covering relation to said ring member; and (d) an aerosol nozzle frangibly connected by tab means to said ring member so as to not be in operable engagement with said aerosol can until the breaking of said tab means by an ultimate user.

11. A closure cap for use on a material dispensing container having a material dispensing member; said cap comprising:

(a) a ring member adapted to securely engage said material dispensing container and be positioned about said material dispensing member;

(b) a closure member hingedly connected to said ring member and adapted to be selectively positioned in covering relation relative to said material dispensing member such that said closure member has a covering position and a noncovering position relative to said material dispensing member; and (c) securing means pivotally connected to said ring member; said securing means being selectively adaptable to retainably engage said closure member in said covering position in a first locking position such that a substantially greater disengagement force must be exerted when secured in said first locking position than when secured in said second locking position.

12. A cap as set forth in claim 10 wherein said nozzle comprises a directionally oriented actuator, said actuator including:

(a) a material dispensing aperture; and (b) a surface positioned opposite said aperture and adapted to fit to the contour of a user's finger when said user is operating said nozzle.

13. A closure cap for use on a material dispensing container having a material dispensing member; said cap comprising:

(a) a ring member adapted to securely engage said material dispensing member and be positioned about said material dispensing member;

(b) a closure member hingedly connected to said ring member and adapted to be selectively positioned in covering relation relative to said material dispensing member such that said closure member has a covering position and a noncovering position relative to said material dispensing member; and (c) securing means hingedly connected to said ring member; said securing means being alternately manipulatable and adapted to selectively secure said closure in said covering position in a first position and a second position; said securing means comprising:

(1) a tang positioned on said closure member; and (2) a tab positioned on said ring member and adapted to retainably engage said tang; said tab having hingeably a first position of a first depth and a second position of a second depth such that substantially more disengagement force is required to disengage said tang when retainably engaged in said first position than when retainably engaged in said second position.

14. In combination with a material dispensing container having a dispensing aperture, a closure cap; said cap comprising:

(a) a ring member spaced from and surrounding said dispensing aperture; said ring member securely engaging said container;

(b) a closure member integrally molded with said ring member and having a pivotal hinge therebetween; said closure member having a covering position relative to said dispensing aperture and a noncovering position wherein said closure member does not cover said dispensing aperture;

(c) a first latch member on said ring member; and (d) a second latch member on said closure member; said first and second latch members cooperating in an overlapping and frictionally engaged relationship to secure said closure member in the covering position thereof; said closure member being sufficiently resilient to allow manipulation of said closure member relative to said ring member so as to separate said first and second latch members.

* * * * *